US005896757A

United States Patent [19]

Kharloubian

[11] Patent Number: 5,896,757

[45] Date of Patent: Apr. 27, 1999

[54] ARTICLE OF JEWELRY WITH A MOVEABLE MOUNTING

[75] Inventor: Joseph Kharloubian, Los Angeles, Calif.

[73] Assignee: T & T Jewelers, Inc., Los Angeles, Calif.

[21] Appl. No.: 08/684,540

[22] Filed: Jul. 19, 1996

[51] Int. Cl.[6] ..... A44C 17/02

[52] U.S. Cl. ..... 63/31; 63/28

[58] Field of Search ..... 63/3, 4, 26, 31, 63/27, 29.1, 30, 32, 28

[56] References Cited

U.S. PATENT DOCUMENTS

| | | | |
|---|---|---|---|
| 3,242,690 | 3/1966 | Kettell | 63/29.1 |
| 3,273,766 | 9/1966 | Cosentino | 63/31 X |
| 4,187,697 | 2/1980 | Castelo | 63/31 |
| 4,294,084 | 10/1981 | Lampert | 63/31 |
| 4,305,262 | 12/1981 | Ferrara | 63/29.1 |

FOREIGN PATENT DOCUMENTS

WO 93/02585 2/1993 WIPO .

*Primary Examiner*—Kien T. Nguyen

*Attorney, Agent, or Firm*—Lewis Anten, Esq.; Amedeo Ferraro, Esq.

[57] ABSTRACT

An article of jewelry is disclosed having a moveable member which may include a gem mounting for holding one or more gem stones in which the moveable member is associated in moveable relationship to the article of jewelry and is capable of moving freely when the article of jewelry is being worn. The travel of the moveable member is not impeded by the skin of the wearer, but travels freely within the tracks of the article of jewelry and the desired result of displaying gems in slideable and/or rotating relationship to an article of jewelry is achieved.

22 Claims, 2 Drawing Sheets

ARTICLE OF JEWELRY WITH A MOVEABLE MOUNTING

BACKGROUND OF THE INVENTION

1. Field of the Invention

The present invention is directed to articles of jewelry such as bracelets, anklets, necklaces and the like, collectively referred to as "articles of jewelry", having one or more mountings for holding a gem stone in moveable relationship to the article of jewelry when the jewelry is being worn.

2. Description of the Related Art

In the past, articles of jewelry have included gem mountings associated in slideable relationship with the jewelry. Referring to FIG. 8 of the drawings, a gem mounting of the prior art in association with an article of jewelry, such as a bracelet, is shown. The prior art bracelet of FIG. 8 includes a pair of parallel tracks for receiving a sliding gem mounting which would move within the tracks of the bracelet. The gem mounting of the prior art protrudes from the upper surface of the bracelet and protrudes from the lower surface of the bracelet that is in contact with the skin. As a result of the contact with the skin of the wearer, the gem mounting of the prior art is impeded from traveling within the tracks by the user's skin and therefore, the gem mounting would not freely move in slideable relationship to the bracelet when it was being worn.

Therefore, there exists a need for an article of jewelry having a gem mounting in moveable relationship to the article of jewelry which is capable of traveling freely with respect to the article of jewelry and unimpeded by the user's skin when the article is being worn.

SUMMARY OF THE PRESENT INVENTION

The present invention discloses an article of jewelry having a moveable member associated in moveable relationship to the article of jewelry in which the moveable member is capable of moving freely and unimpeded when the article of jewelry is being worn. In one embodiment of the present invention, the article of jewelry comprises a moveable member including a gem mounting for holding one or more gem stones and a pair of parallel tracks for receiving the moveable member in slideable relationship with the article of jewelry. The moveable member has a configuration that is capable of being held away from a person's skin when the moveable member is within the tracks of the article of jewelry. In this manner, the travel of the moveable member is not impeded by the skin, but travels freely within the tracks of the article of jewelry and the desired result of displaying the moveable member (which may include one or more gem stones) in moveable relationship to an article of jewelry is achieved.

The article of jewelry of the present invention also includes an alternative embodiment in which the moveable member, in addition to a sliding motion, is capable of rotating about its central axis within the tracks of the article of jewelry. In this manner, the article of jewelry of the present invention is capable of both sliding and rotating movement with respect to the article of jewelry and is capable of displaying gems in a visually desirous fashion.

The present invention presents a novel and improved article of jewelry that is capable of displaying gems in a moveable relationship to the article of jewelry unimpeded by the skin of a person wearing the article of jewelry.

OBJECTS OF THE PRESENT INVENTION

It an object of the present invention provide an article of jewelry that is capable of displaying gems in a slideable movement with respect to the article of jewelry.

It another object of the present invention provide an article of jewelry that is capable of displaying gems in rotating movement with respect to the article of jewelry.

It is yet another object of the present invention provide an article of jewelry that is capable of displaying gems in sliding and rotating movement with respect to the article of jewelry.

It is a further object of the present invention to provide an article of jewelry having a gem mounting associated in moveable relationship to the article of jewelry that is capable of moving freely when the article of jewelry is being worn.

It is a still further object of the present invention to provide an article of jewelry having a gem mounting that is capable of rotational movement relative to the article of jewelry.

It is yet another object of the present invention provide an article of jewelry that is capable of displaying gems in sliding and rotating movement with respect to the article of jewelry.

It is another object of the present invention to provide an article of jewelry for displaying gems in a visually appealing fashion.

It is a further object of the present invention to provide an article of jewelry having a moveable member in moveable relationship with respect to the article of jewelry while the article of jewelry is being worn.

These and other objects of the present invention will become apparent from a review of the accompanying drawings and the detailed description of the drawings.

DETAILED DESCRIPTION OF THE DRAWINGS

Figure 1:
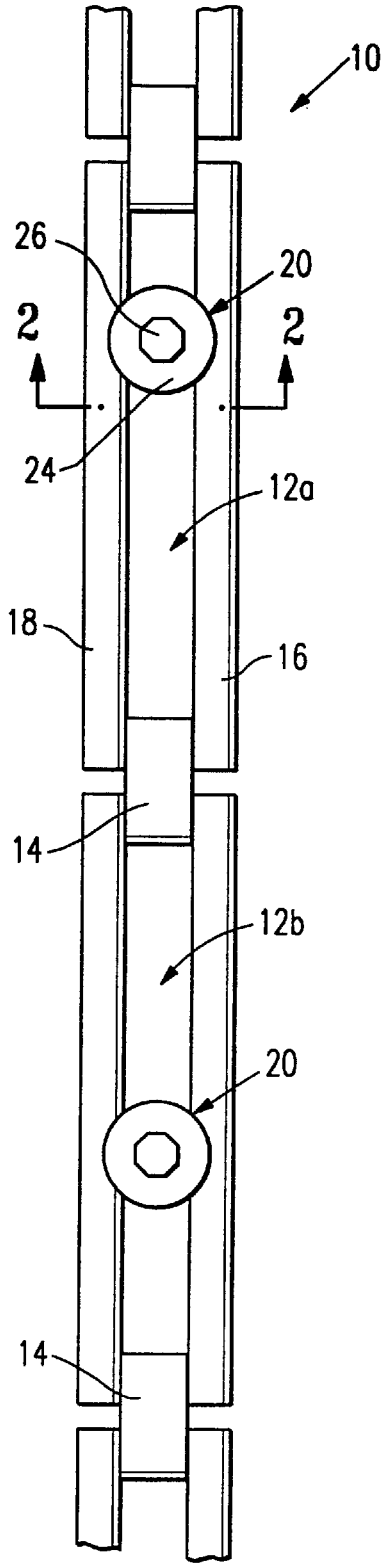
FIG. 1 is a top plan view of an article of jewelry constructed in accordance with the present invention.

Referring to FIG. 1, a top plan view of the article of jewelry of the present invention is shown and generally referred to by the numeral 10. The jewelry 10 has multiple segments 12*a* and 12*b*, each segment being coupled to another by a link 14. The segments 12*a* and 12*b* comprise first and second tracks 16 and 18, respectively, and a moveable member 20 that is fitted between the tracks 16 and 18 and slidably engages the tracks 16 and 18. The moveable member 20 may include a portion that protrudes from the upper surface of the tracks 16 and 18. The moveable member 20 may also comprise a gem mounting for displaying at least one gem 26 which may protrude from the upper surface of the tracks 16 and 18.

Figure 2:
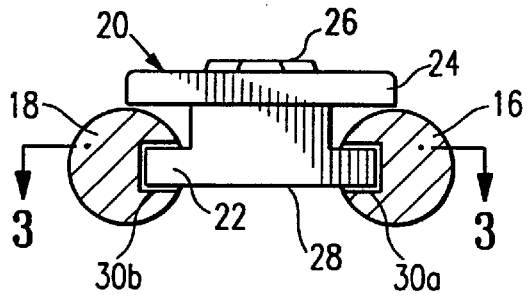
FIG. 2 is a cross sectional view along lines 2—2 of FIG. 1 illustrating the track and gem mounting configuration of the article of jewelry of the present invention.

Referring to FIG. 2, a cross sectional view of the moveable member 20 and the tracks 16 and 18 is shown. The moveable member 20 comprises a base member 22 and a top member 24 which may include a gem mounting for holding one or more gems 26. The top member 24 is shown as having a circular configuration, but it is appreciated that any other configuration suitable for its intended purpose is within the scope of the present invention. The base member 22 of the moveable member 20 has an inverted "T"-shaped configuration and a generally rectangular shaped bottom surface 28.

The inverted "T"-shaped configuration of the base member 22 slideably engages corresponding grooves 30*a* and 30*b* in the first and second tracks 16 and 18, respectively. In this manner, the moveable member 20 is capable of linear movement within the confines of the tracks 16 and 18 and moves relative to the article of jewelry 10.

Figure 3:
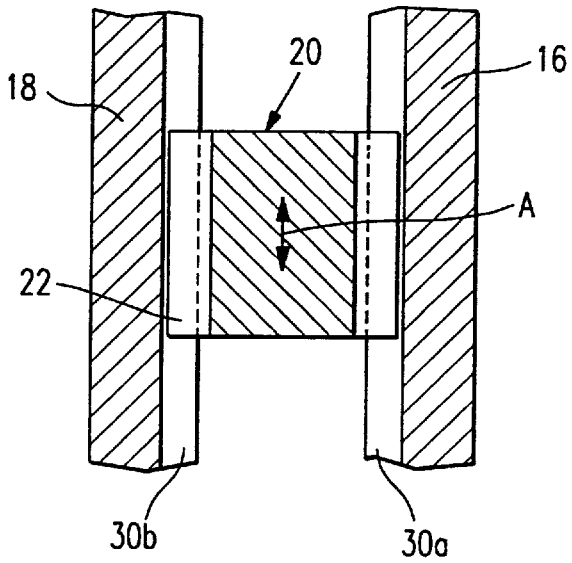
FIG. 3 is a sectional view along line 3—3 of FIG. 2 illustrating the gem mounting in slideable relationship to the article of jewelry of the present invention, with the direction of travel indicated by arrow A.

Referring to FIG. 3, a sectional view of the moveable member 20 is shown with respect to the tracks 16 and 18. The direction of travel of the moveable member 20 within the tracks 16 and 18 is indicated by arrow A. As can be seen from FIGS. 2 and 3, the bottom surface 28 of the moveable member 20 does not extend below the lower surface of tracks 16 and 18. The lower surface of the tracks 16 and 18 normally makes contact with the skin of a person wearing the jewelry 10.

Figure 4:
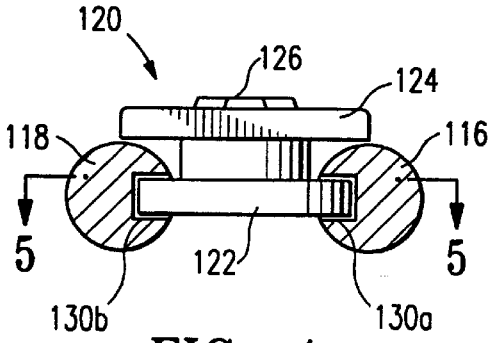
FIG. 4 is a cross sectional view along lines 2—2 of FIG. 1 illustrating an alternative embodiment of the gem mounting of the present invention having a generally circular configuration.
Figure 5:
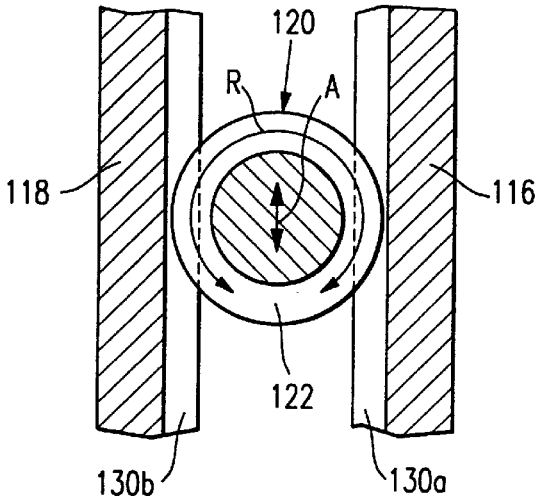
FIG. 5 is a cross sectional view along lines 5—5 of the gem mounting of FIG. 4 with the direction of travel indicated by arrow A and the direction of rotation indicated by arrow R.
Figure 7:
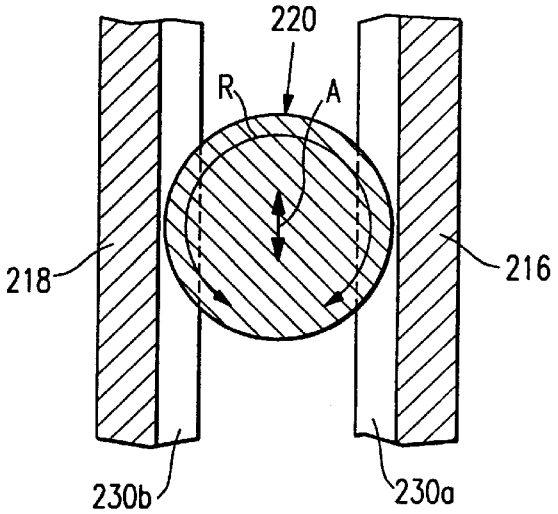
FIG. 7 is a cross sectional view along lines 7—7 of the gem mounting of FIG. 6 with the direction of travel indicated by arrow A and the direction of rotation indicated by the arrow R.

Referring to FIGS. 4 and 5 an alternative embodiment of the moveable member referred to by the numeral 120 is shown relative to the tracks 116 and 118. The moveable member 120 has a circular base member 122 connected to the top member 124 by a narrow stem 125. The circular configuration of the base member 122 allows for the rotation of the moveable member 120 about its central axis within the confines of the tracks 116 and 118. The base member 122 has a bottom surface 128 which does not extend below the bottom surface of the tracks 116 and 118, which bottom surface is placed adjacent to the skin of a person wearing the jewelry 10. As shown in FIG. 5, the moveable member 120 is capable of linear motion relative to the tracks 116 and 118 as indicated by the arrow A. In addition to the linear motion A, the moveable member 120 is capable of rotation about its central axis in the directions indicated by the arrow R.

Figure 6:
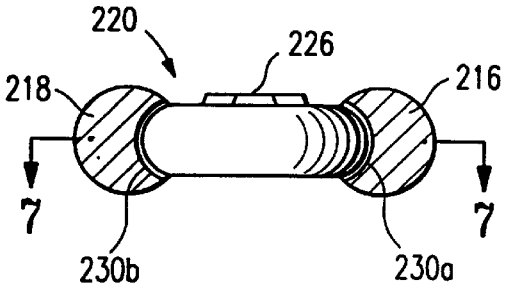
FIG. 6 is a cross sectional view along lines 2—2 of FIG. 1 illustrating an alternative embodiment of the gem mounting of the article of jewelry of the present invention having a generally convex external configuration for mating with generally concave tracks.

Referring to FIGS. 5 and 6, an alternative embodiment of the moveable member 220 is shown which is generally circular in configuration having a convex outer perimeter for engaging corresponding concave grooves 230*a* and 230*b* in tracks 216 and 218 respectively. The moveable member 220 is capable of linear motion as indicated by the arrow A and is also capable of rotational motion about its central axis as indicated by the arrows R. The moveable member 220 has a bottom surface 228 which does not extend below the surface of the tracks 216 and 218.

Figure 8:
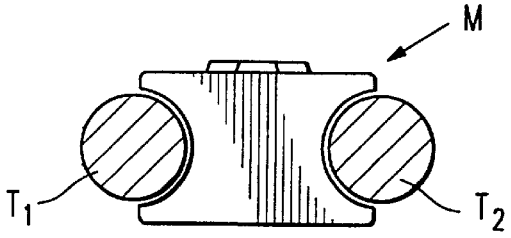
FIG. 8 PRIOR ART
FIG. 8 is a cross sectional view of an article of jewelry of the prior art having a gem mounting protruding from both the upper and lower surfaces of the tracks of an article of jewelry, such that the gem mounting is capable of making contact with the skin of the wearer when in use.

Referring to FIG. 8 a cross sectional view of an article of jewelry of the prior art is shown having a moveable member M. The moveable member M protrudes from the lower surface tracks $T_1$ and $T_2$ and makes contact with the skin of a person wearing the jewelry is shown. The sliding motion of the moveable member M is impeded by the person's skin when the article of jewelry is being worn.

It is appreciated that the article of jewelry of the present invention may be incorporated in a variety of types of jewelry without departing from the scope of the present invention, such as but not limited to bracelets, anklets, necklaces, watchbands, rings, pendants, waistbands, belts, earrings, eye-glass leashes and the like.

It is further appreciated that the moveable member of the article of jewelry of the present invention need not include a gem mounting and gem stone as the movement of the moveable member itself relative to the article of jewelry without a gem stone achieves a visually desirous effect.

While the present invention has been described in detail with regards to the preferred embodiment, it is appreciated that other variations of the present invention may be devised which do not depart from the inventive concept of the present invention.

What is claimed is:

1. An article of jewelry, comprising:

a body having an upper portion and a lower portion in a horizontal plane, said body including a pair of parallel spaced apart tracks for receiving and guiding said moveable member in relationship to said body; and at least one moveable member associated in moveable relationship to said body, said moveable member having a top surface and a bottom surface in a horizontal plane above the horizontal plane of said lower portion of said body, said moveable member being freely moveable relative to said body while at least a part of said lower portion of said body is in contact with a supporting surface, said moveable member having a central axis and being capable of rotating about said central axis within said pair of parallel tracks, said body having a member at each end to prevent disassociation of said moveable member from said body.

2. The article of jewelry of claim 1 in which said moveable member includes means for holding one or more gem stones to said moveable member.

3. The article of jewelry of claim 2 in which said gem holding means comprises a base member and a top member for holding one or more gems.

4. The article of jewelry of claim 3 in which said top member has a circular configuration.

5. The article of jewelry of claim 3 in which said base member has a generally rectangular shaped bottom surface.

6. The article of jewelry of claim 3 in which said base member has a generally circular shaped bottom surface.

7. The article of jewelry of claim 1 in which said moveable member is configured to prevent contact with a person's skin while said moveable member is within said pair of parallel tracks and while said article of jewelry is being worn by a person.

8. The article of jewelry of claim 1 in which said article of jewelry is a bracelet.

9. The article of jewelry of claim 1 in which said article of jewelry is an anklet.

10. The article of jewelry of claim 1 in which said article of jewelry is a necklace.

11. The article of jewelry of claim 1 in which said article of jewelry is a watch band.

12. An article of jewelry, comprising:

a body with a plurality of segments having first and second tracks, each of said first and second tracks having an upper portion and a lower portion for placement against the skin of a person wearing said article of jewelry, each of said plurality of segments being coupled to another of said segments by a linkage; and at least one moveable member associated in moveable relationship to said body while at least a part of said lower portion of said tracks is in contact with the skin, said moveable member being fitted between said tracks and slidably engaging said tracks, said moveable member being capable of rotational movement within the confines of said first and second tracks.

13. The article of jewelry of claim 12 in which said moveable member has at least a portion protruding above said upper portion of said tracks.

14. The article of jewelry of claim 12 in which said moveable member includes at least one gem protruding above said upper portion of said tracks.

15. The article of jewelry of claim 12 in which said moveable member is capable of linear movement within the confines of said first and second tracks.

16. The article of jewelry of claim 12 in which said moveable member has a configuration that does not extend below said lower portion of said tracks.

17. The article of jewelry of claim 12 in which said moveable member is generally circular in configuration having a convex outer perimeter for engaging corresponding concave first and second grooves in each of said first and second tracks.

18. An article of jewelry, comprising:

first and second tracks in spaced apart parallel relationship, each of said first and second tracks having an upper portion and a lower portion in a horizontal plane; and at least one moveable member associated in moveable relationship to said tracks, said moveable member having a bottom surface in a horizontal plane above the horizontal plane of said lower portion of said tracks, said moveable member being fitted between said tracks and slidably engaging said tracks, said moveable member being capable of rotational movement within the confines of said first and second tracks, said tracks having a member at each end to prevent disassociation of said moveable member from said tracks.

19. The article of jewelry of claim 18 in which said moveable member includes means for holding one or more gem stones to said moveable member.

20. The article of jewelry of claim 18 in which said moveable member has a central axis and is capable of rotating about said central axis within said tracks.

21. The article of jewelry of claim 18 in which said moveable member is capable of linear movement within the confines of said first and second tracks.

22. The article of jewelry of claim 18 in which said moveable member has a configuration that does not extend below said lower portion of said tracks.

* * * * *